US011155895B2

(12) United States Patent
Dietz et al.

(10) Patent No.: US 11,155,895 B2
(45) Date of Patent: Oct. 26, 2021

(54) METHOD FOR OBTAINING CESIUM FROM AQUEOUS STARTING SOLUTIONS

(71) Applicants: ALBEMARLE GERMANY GMBH, Frankfurt am Main (DE); Rainer Dietz, Langen (DE); Johannes Willems, Zürich (CH); David Wohlgemuth, Frankfurt (DE); Henrike Rempel, Goslar (DE)

(72) Inventors: Rainer Dietz, Langen (DE); Johannes Willems, Zürich (CH); David Wohlgemuth, Frankfurt (DE); Henrike Rempel, Goslar (DE)

(73) Assignee: Albemarle Germany GmbH, Frankfurt am Main (DE)

( * ) Notice: Subject to any disclaimer, the term of this patent is extended or adjusted under 35 U.S.C. 154(b) by 20 days.

(21) Appl. No.: 16/629,361

(22) PCT Filed: Jul. 9, 2018

(86) PCT No.: PCT/EP2018/068575
§ 371 (c)(1),
(2) Date: Jan. 8, 2020

(87) PCT Pub. No.: WO2019/011876
PCT Pub. Date: Jan. 17, 2019

(65) Prior Publication Data

US 2020/0208239 A1 Jul. 2, 2020

(30) Foreign Application Priority Data

Jul. 11, 2017 (DE) ..... 10 2017 211 796.6

(51) Int. Cl.
*C22B 3/00* (2006.01)
*C22B 3/22* (2006.01)
*C22B 26/10* (2006.01)

(52) U.S. Cl.
CPC ..... *C22B 3/22* (2013.01); *C22B 26/10* (2013.01)

(58) Field of Classification Search
CPC ..... C01D 17/003; C22B 3/22; C22B 26/10
See application file for complete search history.

(56) References Cited

U.S. PATENT DOCUMENTS 6,214,234 B1 * 4/2001 Harjula ..... C01C 3/11 210/682

OTHER PUBLICATIONS

Ivanova, L.M. et al.; "Method for the Simultaneous Determination of 90Sr, 137Cs and 144CeIN Seawater" Radiochemistry; vol. 9, No. 5, 1967; pp. 622-633; (with translation 30 pages).
Lehto, Jukka et al.; "Industrial Scale Removal of Cesium with Hexacyanoferrate Exchanger Process Development" XP-000885640; vol. 2; 1993; pp. 1693-1696.
Tananaev, I.V. et al.; "On Mixed Calcium Ferrocyanides with Rubidium and Cesium"; Journal of Inorganic Chemistry vol. II; Issue 3; 1957; pp. 600-603; (with translation 9 pages).
Zhang, Nan et al.; "Rubidium and Cesium Recovery from Brine Resources"; Advanced Materials Research; ISSN 1662-8985; vol. 1015; 2014; pp. 417-420.

* cited by examiner

*Primary Examiner* — Steven J Bos
(74) *Attorney, Agent, or Firm* — Marcy M. Hoefling; Troy S. Kleckley; Nathan C. Dunn

(57) ABSTRACT

The disclosed subject matter relates to a method for obtaining cesium from aqueous solutions.

18 Claims, No Drawings

METHOD FOR OBTAINING CESIUM FROM AQUEOUS STARTING SOLUTIONS

CROSS-REFERENCE TO RELATED APPLICATIONS

This application is a National Stage of International Application No. PCT/EP2018/068575, filed on Jul. 9, 2018, which application claims priority from German Patent Application No. 10 2017 211 796.6, filed Jul. 11, 2017. Each patent application identified above is incorporated here by reference in its entirety.

FIELD

The invention relates to a method for obtaining cesium from aqueous starting solutions, and more particularly to a method for obtaining cesium from aqueous starting solutions with cesium ion contents in the range of 50 ppm to 5000 ppm, which accumulate as natural deposits, for example, in saline lake brines geothermal sources or sea water concentrates but also in waste water of cesium extraction from minerals or lithium extraction.

BACKGROUND

From the document "Rubidium and Cesium Recovery from Brine Resources," Nan ZHANG et al., Advanced Materials Research, Vol. 1015 (2014), pp. 417-420, different methods for rubidium and cesium recovery by fractional precipitation, ion exchange or solution extraction are known.

The aim of the invention is to indicate a method for the economic extraction of cesium which moreover can ensure compliance with environmental waste water limit values by cesium (Cs) removal for the discharge of waste water into bodies of water and which largely tolerates many interfering ions as well as contaminants.

SUMMARY

In general, the present disclosure provides a method for obtaining cesium from aqueous solutions.

In an aspect, a method is provided for obtaining cesium from aqueous starting solutions with cesium ion contents in a range of 50 ppm to 5000 ppm, characterized in that the cesium ions in the aqueous solution are, in a first step, precipitated as a double salt having divalent cations with the aid of an at least 1.1-times overstoichiometric amount of solutions containing prussiate of potash selected from the group consisting of $K_4[Fe(CN)_6]$, $Na_4[Fe(CN)_6]$, $Ca_2[Fe(CN)_6]$, or mixtures thereof, in the pH range of 2 to 12 and the temperature range of 10° C. to 80° C., wherein the divalent cations are either already present in the starting solutions in an amount equimolar to the cesium content or added as a water-soluble salt, and, in a second step, they are converted back into a water-soluble form by thermal decomposition and, in a third step, separated from the insoluble residues.

One or more aspects include the method of the preceding paragraph characterized in that aqueous starting solutions with cesium ion contents in the range of 100 ppm to 1000 ppm are used.

One or more aspects include the method of any preceding paragraph characterized in that an overstoichiometric amount of solutions containing alkali prussiate of potash in the range of the 1.15- to 1.5-times the stoichiometric amount is used.

One or more aspects include the method of any preceding paragraph characterized in that, as divalent cations, calcium and/or magnesium ions are obtained in at least equimolar amount or added at least until the equimolar amount is reached.

One or more aspects include the method of any preceding paragraph characterized in that the precipitation of the double salt is carried out in a first step in the pH range of 4 to 11.

One or more aspects include the method of any preceding paragraph characterized in that the precipitation of the double salt is carried out with the addition of inorganic filtering aids.

One or more aspects include the method of any preceding paragraph characterized in that the overstoichiometric amount of prussiate of potash remaining in the starting solution is precipitated by the addition of a water-soluble iron(III) salt in the pH range of 4 to 7 to the already formed double salt.

One or more aspects include the method of the preceding paragraph characterized in that iron(III) sulfate is used in an excess of up to 100% by weight with respect to the amount of alkali prussiate of potash remaining in the solution.

One or more aspects include the method of any preceding paragraph characterized in that the thermal decomposition in the second step is carried out in a calcining step under oxidative conditions at temperatures of 400° C. to 800° C.

One or more aspects include the method of the preceding paragraph characterized in that the calcining residue is introduced into demineralized water and the soluble components are separated from the insoluble components.

One or more aspects include the method of the preceding paragraph characterized in that the cesium salts contained in the solution are further purified by recrystallization.

DESCRIPTION

According to the invention, the aim is achieved by a method for extracting cesium from aqueous starting solutions with cesium ion contents in the range of 50 ppm to 5000 ppm, in which method, in a first step, the cesium ions contained in the aqueous solutions are precipitated as a double salt having divalent cations with the aid of an at least 1.1-times overstoichiometric amount of solutions containing prussiate of potash, selected from the group consisting of $K_4[Fe(CN)_6]$, $Na_4[Fe(CN)_6]$, $Ca_2[Fe(CN)_6]$ or mixtures thereof, in a pH range of 2 to 12 and a temperature range of 10 to 80° C., wherein the divalent cations are either already present in the starting solutions in an amount at least equimolar to the cesium content or added as a water-soluble salt at least until reaching the equimolar amount, and, in a second step, they are converted back into a water-soluble form by thermal decomposition and, in a third step, separated from the insoluble residues. The invention is characterized by the use of typical "contaminants" in aqueous solutions such as, for example, magnesium and calcium, in order to precipitate the cesium present, by the addition of yellow prussiate of potash, as a mixture of different sparsely soluble double salts having the exemplary composition $Cs_2Mg[Fe(CN)_6]$ and $Cs_2Ca[Fe(CN)_6]$, and to remove it by filtration.

Preferably, aqueous starting solutions with cesium ion contents in the range of 100 ppm to 1000 ppm are used.

Particularly preferable is a method in which an overstoichiometric amount of solutions containing prussiate of potash in the range of 1.15- to 1.5-times the stoichiometric amount, which shifts the precipitation equilibrium far toward the product side.

Also preferable is a method in which, as divalent cations, calcium and/or magnesium ions are contained in at least equimolar amount or added at least until the equimolar amount is reached.

In the method, it is particularly preferable that the precipitation of the double salt is carried out in a first step in a pH range of 4 to 11.

The method can advantageously be designed in that the precipitation of the double salt is carried out with addition of inorganic filtering aids such as kieselguhr or diatomaceous earth.

A particularly advantageous variant of the method consists in that the overstoichiometric amount of alkali prussiate of potash salt remaining in the starting solution is precipitated by the addition of a water-soluble iron(III) salt in the pH range of 4 to 7 to the already formed double salt. The applied excess of prussiate of potash is precipitated by addition of iron(III) salts and separated. The $Cs_2Mg[Fe(CN)_6]$ crystals already present act as "seed crystals" for the Prussian blue, which as a result can be removed more simply by filtration. Surprisingly, the Prussian blue binds on its surface additional cesium from the solution by adsorption, so that the residual solubility of Cs in the 20 ppm solution (only by precipitation $Cs_2Mg[Fe(CN)_6]$ and $Cs_2Ca[Fe(CN)_6]$) can be reduced to approximately 10 ppm. Advantageously, with this step, not only is the necessary excess of yellow prussiate of potash removed from the solution, but at the same time a further and improved Cs enrichment is achieved. This increases the Cs yield in the case of optimal consumption of the precipitation reagent used and thus also makes it possible to economically use water sources with low cesium contents.

The method can be further improved in that iron(III) sulfate is used in an excess of up to 100% by weight with respect to the amount of alkali prussiate of potash remaining in the starting solution.

The method is particularly advantageous since the thermal decomposition in the second step is carried out in a calcining step under oxidative conditions at temperatures of 400° C. to 800° C.

Advantageously, in the method, the calcining residue is introduced into demineralized water, in accordance with the DIN specification, standard DIN 55997 (2006-12), and the soluble components are separated from the insoluble components.

In an advantageous design of the method, the cesium salts contained in the solution are further purified by recrystallization.

The precipitation is advantageously carried out in a reaction vessel without intermediate filtration at room temperature. The reaction is rapid, with a reaction time of approximately 1 hour, and tolerant with respect to other contaminants. The filter residue consists of a mixture of different sparsely soluble Cs salts which contain, with respect to the weight after separation of the mother liquor, approximately 40 to 50% by weight of cesium.

The moist precipitation salt mixture is converted in a calcining step in air at 600° C. into insoluble oxides and soluble Cs compounds. Except for the cesium components and Na/K, all the other elements form water-insoluble hydroxides, oxides or carbonates. The calcining residue is leached with water, and a Cs salt solution is obtained, from which the insoluble components are removed by filtration. By washing or resuspension of the residue in water, the Cs yield can be increased to approximately 90%.

In summary, the present invention has the following advantages:

a) economic recovery of Cs compounds, b) compliance with environmental waste water limit values by Cs removal for the discharge of waste water into bodies of water, c) utilization for removing radioactive $^{137}Cs$ from wastewater and thus reduction of the radiation amount, d) use of cost-effective precipitants such as $K_4[Fe(CN)_6]$, $Na_4[Fe(CN)_6]$, $Ca_2[Fe(CN)_6]$ or mixtures thereof, e) very reliable reaction running independently of numerous interfering ions and contaminants, wherein the precipitation occurs rapidly, f) good filtration properties of the Prussian blue which is otherwise difficult to filter, by epitaxial growth on the $Cs_2Ca[Fe(CN)_6]$ crystals already present, g) simple procedural steps in the form of stirring, precipitation, filtration, h) optimal use of the precipitation reagent The invention is explained further below in reference to an embodiment example.

EXAMPLES

Example 1

Precipitation of Cs ferrocyanide from concentrated, natural, chloride containing salt solution pH 4 to 10 (brine with 14% by weight NaCl, 7% by weight $CaCl_2$), 1% by weight $MgCl_2$, <1% by weight KCl, <1% by weight $SrCl_2$)

$$2\ \underset{484.07}{Na_4[Fe(CN)6]} \times 10\ H_2O + 2\ CaCl2 + 4\ CsCl \rightarrow$$

$$Cs_4[Fe(CN)_6] * \underset{1035.69}{Ca_2}[Fe(CN)\alpha + 8\ NaCl$$

$$3(Fe(CN)_6)^{4-} + 4\ Fe^{3+} \xrightarrow{*} Fe[FeFe(CN)_6]_3 \times 14\text{-}16\ H_2O\downarrow$$

TABLE 1

Precipitation of Cs ferrocyanide and subsequent precipitation of Prussian blue

| | Molecular weight g/mol | Molarity mmol | Weight g | Remarks |
|---|---|---|---|---|
| Salt solution amount with content of | — | — | 15 000 | |
| Cs 470 ppm | 132.91 | 53.0 | 7.05 | |
| Ca 2.6% by weight | 40.08 | 9730 | 390 | |
| Mg 0.27% by weight | 24.31 | 1666 | 40 | |

TABLE 1-continued

| Precipitation of Cs ferrocyanide and subsequent precipitation of Prussian blue | | | | |
|---|---|---|---|---|
| | Molecular weight g/mol | Molarity mmol | Weight g | Remarks |
| Addition | | | | |
| $Na_4[Fe(CN)_6] \times 10\ H_2O$ | 484.07 | 36.7 | 17.8 | Excess: +38% by weight +10.2 mmol |
| $Fe_2(SO_4)_3$ (21% by weight Fe) | 399.88 | 11.2 22.4 mmol Fe | 6.0 g (75% by weight) | Excess: +120% by weight +12 mmol |

$Na_4[Fe(CN)_6]\times 10\ H_2O$ is added at room temperature in the form of an aqueous solution or a solid and stirred for 30 minutes. The precipitation occurs spontaneously. Subsequently, $Fe_2(SO_4)_3$ is added in the form of an aqueous solution or a solid and stirred for 30 minutes.

The further precipitation also occurs spontaneously. Subsequently, filtration through a folded paper filter is carried out, and the unwashed residue is dried at 100° C.

Starting solution 15 0008 g with 470 ppm Cs (7.1 g Cs)

Filtrate: 15 0008 g with 20 ppm Cs (0.3 g Cs)

Residue: 25.8 g with 26% by weight Cs (6.78 g Cs, 98% of the theory)

TABLE 2

| Analysis of the filtered leaching solution | | | | | | | |
|---|---|---|---|---|---|---|---|
| | Cs % by weight | Fe % by weight | Ca % by weight | Mg % by weight | Na % by weight | Sr % by weight | K % by weight |
| Starting solution | 0.047 | <0.0001 | 2.6 | 0.27 | 5.5 | 0.15 | 0.14 |
| Solution after precipitation of Cs ferrocyanide | 0.003 | 0.0014 | 2.6 | 0.27 | 5.5 | 0.15 | 0.13 |
| Solution after precipitation of excess ferrocyanide | 0.002 | 0.0041 | 2.6 | 0.27 | 5.4 | 0.15 | 0.13 |
| Residue of the two precipitations (unwashed, dried) | 26 | 10.1 | 5.3 | 1.9 | 3.9 | 0.15 | 0.25 |
| Final solution of the residue of the thermal decomposition | 4.5 | <0.0001 | 0.001 | 0.0001 | 0.9 | 0.005 | 0.04 |

5.0 g of the residue are heated in a crucible made of $Al_2O_3$ in the tube furnace at 600 CC, the temperature is maintained for 3 h, and 50 l„/h of air is passed over it. The waste gas is introduced into a solution of $H_2O_2$ and NaOH, in order to oxidize poisonous waste gases such as CO, $(CN)_2$ and HCN. Residue: 4.0 g (weight loss: 20% by weight)

Leaching residue: oxides/hydroxides/carbonates of Fe, Ca, Mg, Sr and K.

Table 3 shows the composition of the Cs solution obtained by thermal decomposition of the precipitation residue and leaching of the decomposition residue with at least the amount of demineralized water necessary for complete dissolution.

TABLE 3

| Analysis of the product solution | | |
|---|---|---|
| | % by weight | meq/g |
| $Cs^+$ | 4.5 +/− 0.2 | 0.34 |
| $Na^+$ | 0.92 | 0.40 |

TABLE 3-continued

| Analysis of the product solution | | |
|---|---|---|
| | % by weight | meq/g |
| $Ca^{2+}$ | 0.0013 | 0.0003 |
| $K^+$ | 0.04 | 0.01 |
| Total | | 0.75 |
| $OH^-$ | | 0.10 |
| $CO_3^{2-}$ | 0 | 0 |
| $Cl^-$ | | 0.67 |

TABLE 3-continued

| Analysis of the product solution | | |
|---|---|---|
| | % by weight | meq/g |
| $SO_4^{2-}$ | 0.03 | 0.006 |
| $NO_3^-$ | 0.12 | 0.02 |
| Total | | 0.79 |

The residue of the thermal decomposition is leached here with at least the amount of demineralized water necessary for complete dissolution and is separated by filtration from insoluble components. The aqueous solution contains 1.4 g Cs (100% of the theory).

Composition of the solution: 3.8% by weight CsCl/1.7% by weight CsOH/2.3% by weight NaCl/<0.1% by weight KCl.

What is claimed is:

1. A method for obtaining cesium from aqueous starting solutions with cesium ion contents in the range of 50 ppm to 5000 ppm, characterized in that the cesium ions in the aqueous solution are, in a first step, precipitated as a double salt having divalent cations with an at least 1.1 times overstoichiometric amount of solution containing prussiate selected from the group consisting of $K_4[Fe(CN)_6]$, $Na_4[Fe(CN)_6]$, $Ca_2[Fe(CN)_6]$ and mixtures thereof, in the pH range of 2 to 12 and in the temperature range of 10 to 80° C., wherein the divalent cations are either already present in the starting solutions in an amount at least equimolar to the cesium ion contents or added as a water-soluble salt, and, in a second step, the cesium ions are converted back into a water-soluble form by thermal decomposition carried out in a calcining step under oxidative conditions at temperatures of 400° C. to 800° C. and, in a third step, the cesium ions are separated from insoluble residues.

2. The method according to claim 1, characterized in that aqueous starting solutions with cesium ion contents in the range of 100 ppm to 1000 ppm are used.

3. The method according to claim 1, characterized in that an overstoichiometric amount of solution containing prussiate in the range of 1.15 to 1.5 times the stoichiometric amount is used.

4. The method according to claim 1, characterized in that, as divalent cations, calcium and/or magnesium ions are obtained in at least equimolar amount or added at least until the equimolar amount is reached.

5. The method according to claim 1, characterized in that the precipitation of the double salt is carried out in a first step in the pH range of 4 to 11.

6. The method according to claim 1, characterized in that the precipitation of the double salt is carried out with the addition of inorganic filtering aids.

7. The method according to claim 1, characterized in that the overstoichiometric amount of prussiate remaining in the starting solution is precipitated by the addition of a water-soluble iron(III) salt in the pH range of 4 to 7 to the already formed double salt.

8. The method according to claim 7, characterized in that iron(III) sulfate is used in an excess of up to 100% by weight with respect to the amount of prussiate remaining in the solution.

9. The method according to claim 1, characterized in that a calcining residue formed in the calcining step is introduced into demineralized water and soluble components are separated from insoluble components.

10. The method according to claim 9, characterized in that the cesium salts contained in the solution are further purified by recrystallization.

11. The method according to claim 2, characterized in that an overstoichiometric amount of solutions containing prussiate in the range of 1.15 to 1.5 times the stoichiometric amount is used.

12. The method according to claim 11, characterized in that, as divalent cations, calcium and/or magnesium ions are obtained in at least equimolar amount or added at least until the equimolar amount is reached.

13. The method according to claim 12 characterized in that, as divalent cations, calcium and/or magnesium ions are obtained in at least equimolar amount or added at least until the equimolar amount is reached.

14. The method according to claim 13, characterized in that the precipitation of the double salt is carried out in a first step in the pH range of 4 to 11.

15. The method according to claim 14, characterized in that the precipitation of the double salt is carried out with the addition of inorganic filtering aids.

16. The method according to claim 15, characterized in that the overstoichiometric amount of prussiate remaining in the starting solution is precipitated by the addition of a water-soluble iron(III) salt in the pH range of 4 to 7 to the already formed double salt.

17. The method according to claim 16, characterized in that iron(III) sulfate is used in an excess of up to 100% by weight with respect to the amount of prussiate remaining in the solution.

18. The method according to claim 17, characterized in that a calcining residue formed in the calcining step is introduced into demineralized water and the soluble components are separated from the insoluble components.

* * * * *